US011319829B2

(12) United States Patent
Strock

(10) Patent No.: US 11,319,829 B2
(45) Date of Patent: May 3, 2022

(54) GEOMETRICALLY SEGMENTED ABRADABLE CERAMIC THERMAL BARRIER COATING WITH IMPROVED SPALLATION RESISTANCE

(71) Applicant: Raytheon Technologies Corporation, Farmington, CT (US)

(72) Inventor: Christopher W. Strock, Kennebunk, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 17/327,938

(22) Filed: May 24, 2021

(65) Prior Publication Data

US 2021/0277792 A1 Sep. 9, 2021

Related U.S. Application Data

(62) Division of application No. 16/165,233, filed on Oct. 19, 2018, now Pat. No. 11,015,474.

(51) Int. Cl.
*F01D 11/12* (2006.01)
*B05D 7/00* (2006.01)

(52) U.S. Cl.
CPC ..... *F01D 11/122* (2013.01); *B05D 7/56* (2013.01); *B05D 2350/63* (2013.01); *F05D 2220/3212* (2013.01); *F05D 2230/90* (2013.01); *F05D 2240/55* (2013.01); *F05D 2300/6033* (2013.01)

(58) Field of Classification Search
None
See application file for complete search history.

(56) References Cited

U.S. PATENT DOCUMENTS

| | | | | |
|---|---|---|---|---|
| 4,289,447 | A * | 9/1981 | Sterman | F01D 11/125 264/642 |
| 8,361,244 | B2 | 1/2013 | Peterson et al. | |
| 9,598,973 | B2 | 3/2017 | Ghasripoor et al. | |
| 9,713,912 | B2 | 7/2017 | Lee | |
| 2004/0213675 | A1 * | 10/2004 | Blangetti | F04D 29/324 416/241 R |
| 2006/0056960 | A1 | 3/2006 | Sabol et al. | |
| 2008/0102296 | A1 * | 5/2008 | Ghasripoor | C23C 14/18 428/469 |
| 2016/0201498 | A1 | 7/2016 | Farris et al. | |
| 2016/0251970 | A1 | 9/2016 | Strock et al. | |
| 2018/0066527 | A1 | 3/2018 | Kadau et al. | |

* cited by examiner

*Primary Examiner* — Michael P. Rodriguez
(74) *Attorney, Agent, or Firm* — Bachman & LaPointe, P.C.

(57) ABSTRACT

A turbine article includes a substrate with a geometric surface having a multiple of divots recessed into the substrate, and a ceramic topcoat disposed over the geometric surface, the topcoat including at least a first layer having a first hardness and a second layer having a second hardness, the first hardness different than the second hardness.

13 Claims, 4 Drawing Sheets

GEOMETRICALLY SEGMENTED ABRADABLE CERAMIC THERMAL BARRIER COATING WITH IMPROVED SPALLATION RESISTANCE

CROSS-REFERENCE TO RELATED APPLICATION

This application is a divisional of U.S. patent application Ser. No. 16/165,233, filed Oct. 19, 2018.

BACKGROUND

The present disclosure is directed to a geometrically segmented abradable ceramic (GSAC) coating with a multiple of toughened layers for spallation resistance.

Components that are exposed to high temperatures, such as gas turbine engine turbine blades, turbine vanes, blade outer air seals, and compressor components, typically include protective coatings. The protective coatings may include one or more layers that function to protect the component from erosion, oxidation, corrosion, or the like to enhance component durability and maintain efficient operation of the engine.

A geometrically segmented abradable ceramic (GSAC) coating has been demonstrated in high gradient thermal cycle testing to survive surface temperatures in the range of 3200 degrees F. (1760 degrees C.). Recent testing has shown significant gains in durability and temperature capability over conventional thermal barrier coatings, however, some GSAC coatings may still be subject to spallation at inter-segment edges due to crack formation from the stresses associated with sintering shrinkage.

SUMMARY

A turbine article according to one disclosed non-limiting embodiment includes a substrate with a geometric surface having a multiple of divots recessed into the substrate; and a ceramic topcoat disposed over the geometric surface, the ceramic topcoat comprising a first layer having a first hardness, a second layer on the first layer, the second layer having a second hardness, the first hardness different than the second hardness, a third layer on the second layer, the third layer having a hardness about equivalent to the first hardness, wherein the third layer is flush with a top surface of the geometric surface.

A further aspect includes that the first layer is located within a bottom of each of the multiple of divots and on the raised area surrounding each divot.

A further aspect includes a fourth layer on the third layer, the fourth layer having a hardness about equivalent to the second hardness.

A further aspect includes a fifth layer on the fourth layer, the fifth layer having a hardness about equivalent to the first hardness.

A further aspect includes that the coating is machined to remove the portion of the fourth and fifth layers that are raised above the fourth and fifth layers located in the divot locations to produce a smooth surface.

A further aspect includes that the fifth layer is about 5-20 mils thick prior to being machined.

A further aspect includes that the fifth layer is about 3-10 mils thick after being machined.

A further aspect includes that the first layer is 1-3 mils thick and the second layer is 6-50 mils thick.

A further aspect includes that a divot depth of each of the multiple of divots of the geometric surface is 10-50 mils, the first layer thickness spans from 0-15% of the divot depth (with 0% being the bottom of the divot) and the third layer thickness spans 90-115% the divot depth.

A further aspect includes that each of the multiple of divots of the geometric surface comprises a substantially uniform divot depth extending into the substrate and a divot width, wherein the ratio of the divot width to the divot depth is 1 to 10, with the divot depth being at least 0.01 inches (0.254 millimeters).

A further aspect includes a bond coat between the substrate and the first layer.

A further aspect includes that the substrate is at least one of metallic, monolithic ceramic, metal matrix composite and a ceramic matrix composite.

A further aspect includes that the article is a blade outer air seal.

A process for manufacturing a geometrically segmented abradable coating on a turbine engine component, the process according to one disclosed non-limiting embodiment includes depositing a first layer of a ceramic topcoat on a geometric surface and within a bottom of each of a multiple of divots, the first layer having a first hardness; depositing a second layer of the ceramic topcoat on the first layer, the second layer having a second hardness, the first hardness higher than the second hardness; and depositing a third layer on the second layer, the third layer having a hardness about equivalent to the first hardness, at the divot locations, the third layer corresponds with a top surface of the geometric surface and the first layer on the top surface of the geometric surface.

A further aspect includes depositing a fourth layer on the third layer, the fourth layer having a hardness about equivalent to the second hardness; depositing a fifth layer on the fourth layer, the fifth layer having a hardness about equivalent to the first hardness; and machining the ceramic topcoat.

A further aspect includes that machining the ceramic topcoat comprises removing raised material over a substrate feature.

A further aspect includes redepositing at least a portion of the fifth layer.

A further aspect includes that the third layer corresponds with the top surface of the geometric surface and the first layer on the op surface of the geometric surface.

A further aspect includes that the third layer thickness spans the top surface of the geometric surface.

A further aspect includes a divot depth of the geometric surface is 10-50 mils, the first layer thickness spans from 0-15% of the divot depth (with 0% being the bottom of the divot) and the third layer thickness spans 90-115% the divot depth.

The foregoing features and elements may be combined in various combinations without exclusivity, unless expressly indicated otherwise. These features and elements as well as the operation thereof will become more apparent in light of the following description and the accompanying drawings. It should be appreciated that the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
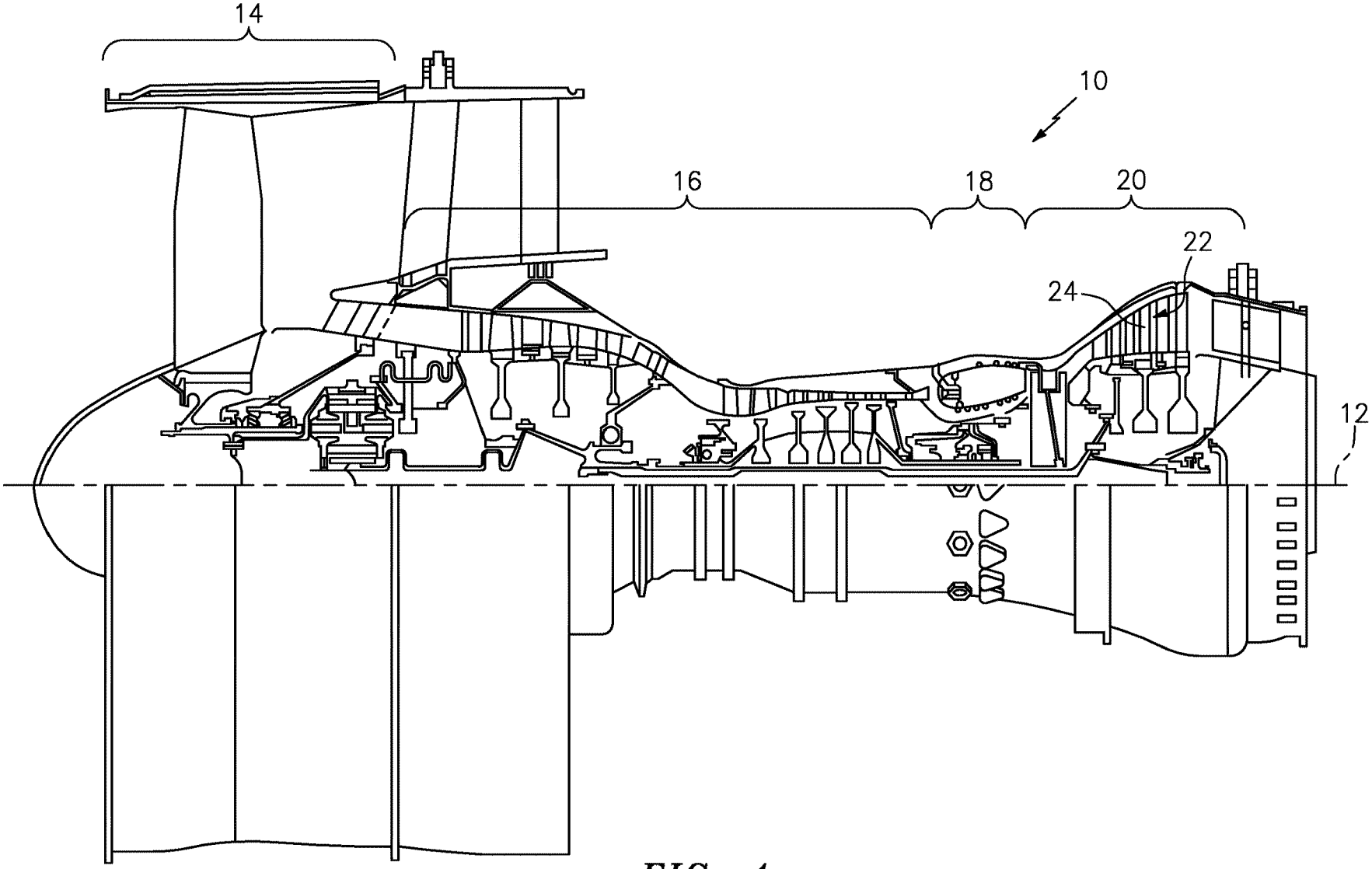
FIG. 1 is a schematic representation of an exemplary turbine engine.

FIG. 1 schematically illustrates a gas turbine engine 10. The gas turbine engine 10 is disclosed herein as a two-spool turbofan that generally incorporates a fan section 14, a compressor section 16, a combustor section 18 and a turbine section 20 that includes rotating turbine blades 22 and static turbine vanes 24. The fan section 14 drives air along a bypass flowpath and a core flowpath. The compressor section 16 drives air along the core flowpath for compression and communication into the combustor section 18, then expansion through the turbine section 18. Although depicted as a turbofan in the disclosed non-limiting embodiment, it should be appreciated that the concepts described herein are not limited to use with turbofans as the teachings may be applied to other types of turbine engine architectures such as geared architectures, turbojets, turboshafts, and three-spool (plus fan) turbofans.

Figure 2:
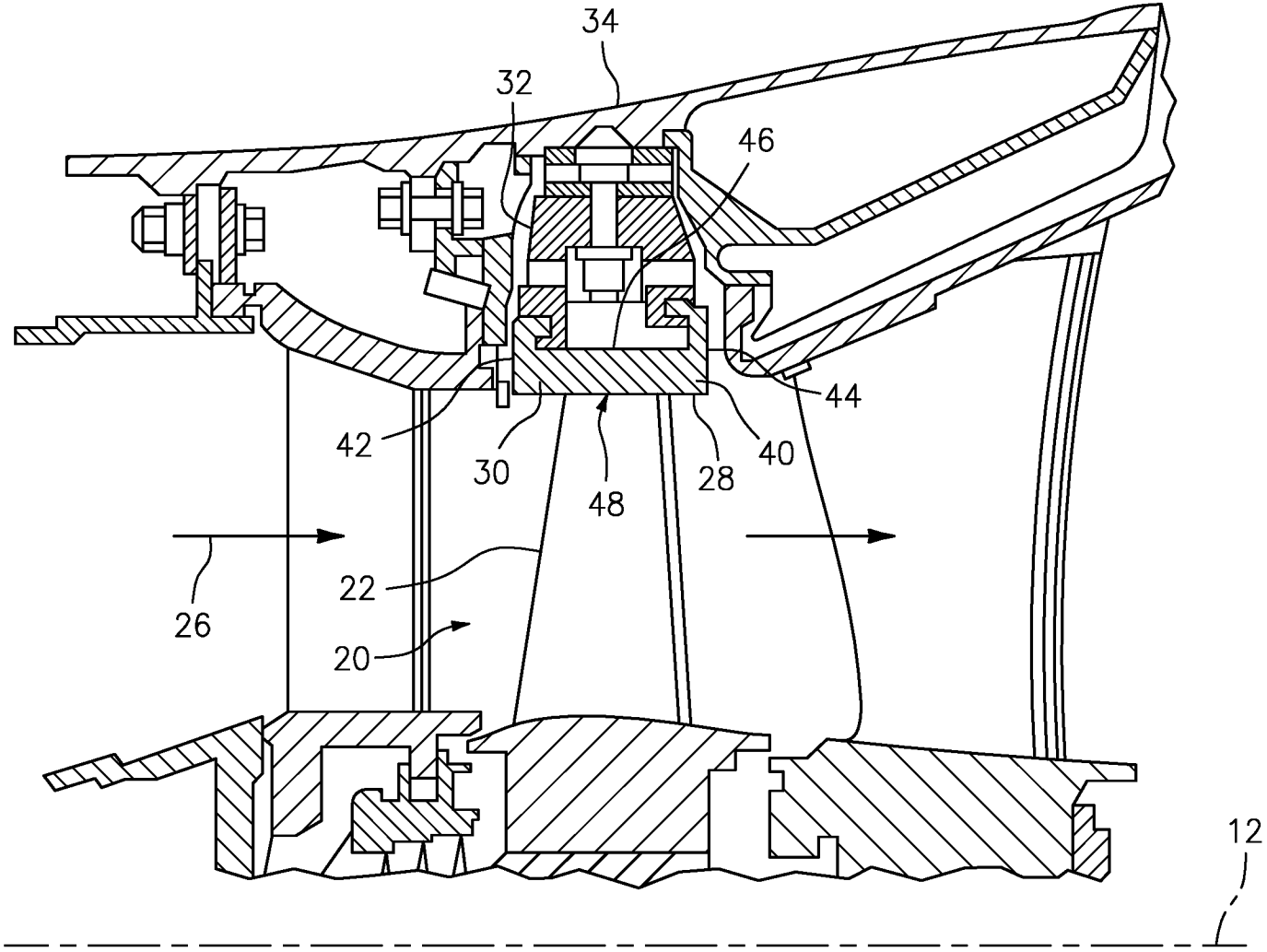
FIG. 2 is a turbine section of the turbine engine.

FIG. 2 illustrates selected portions of the turbine section 20 that receives a hot core gas flow 26 from the combustion section 18 (FIG. 1). The turbine section 20 includes a blade outer air seal system 28 having a multiple of blade outer air seal (BOAS) members 30 that function as an outer wall for the hot gas flow 26 through the turbine section 20. Although a BOAS is illustrated in a disclosed embodiment, blades, vanes, blade and vane platforms, shrouds, combustor components including fuel nozzles, fuel nozzle guides, heat shields, transition ducts and others will benefit herefrom.

Each seal member 30 is secured to a support 32, which is secured to a case 34 of the turbine section 20. The seal member 30 is but one example of a gas turbine article that may benefit from that disclosed herein, such as turbine blades, turbine vanes, turbine blade outer air seals and combustor components. Other applications can include afterburner exhaust guides, rocket nozzles, industrial combustion nozzles and heat shields such as in coal gasification and other elevated temperature reactors. The seal member 30 includes a circumferential portion 40, a leading portion 42, a trailing portion 44, a radially outer side 46, and a radially inner side 48 adjacent to the hot gas flow 26. The term "radially" relates to the orientation of a particular side with reference to the engine centerline 12.

Figure 3:
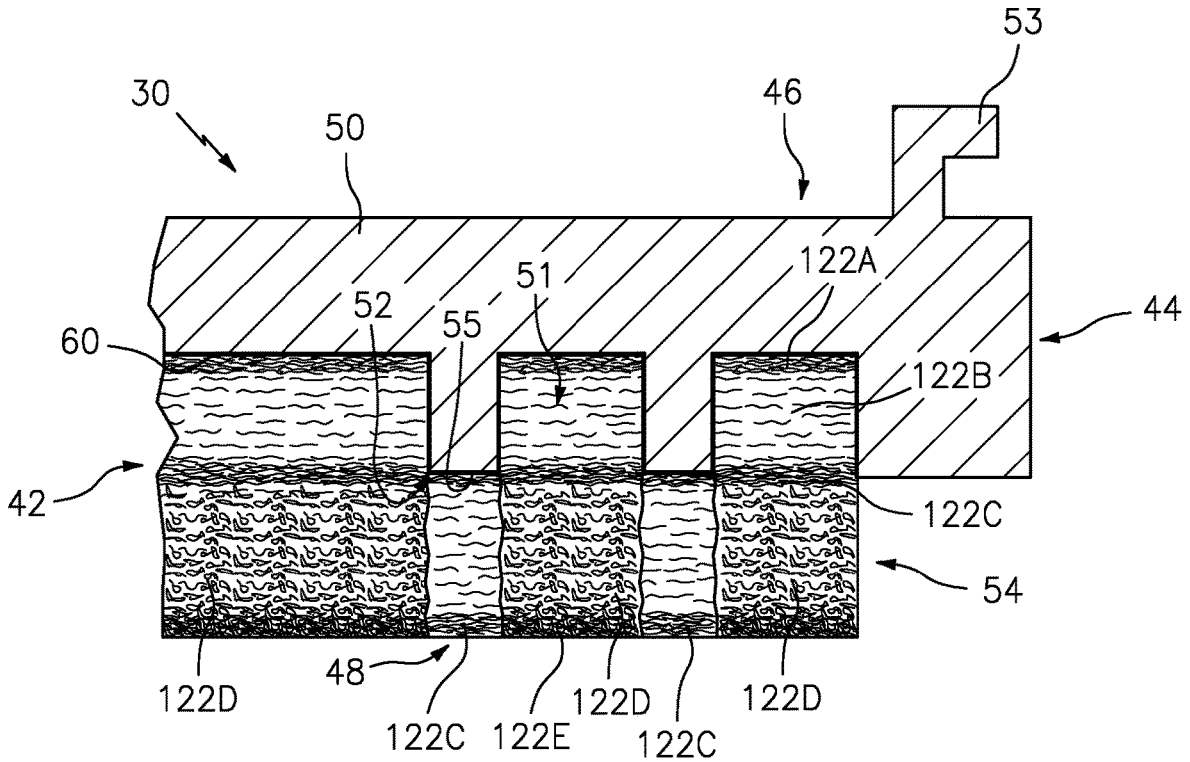
FIG. 3 is an exemplary portion of a turbine article.

With reference to FIG. 3, the seal member 30 includes a substrate 50 having a geometrically segmented abradable ceramic (GSAC) surface 52, e.g., divoted surface. The substrate 50 may include attachment features 53 for mounting the seal member 30 to the support 32. The geometrically segmented abradable ceramic (GSAC) surface 52 includes a multiple of divots 51. FIG. 3 illustrates only a portion of the seal member 30 in the axial direction. In embodiments, each divot 51 may be cylindrical, hexagonal, rectilinear, etc. The multiple of divots 51 can be arranged in a honeycomb pattern or any other suitable pattern. The surface 52 can be a continuous feature, as in the raised portion between cells of a honeycomb structure, or discontinuous, as in multiple separate raised surfaces.

The substrate 50 can be manufactured of a metallic material, for example, Inconel 718 available from Special Metals, Corp. of Miami, Fla., PWA1484, WA Specialty Alloys Pty Ltd of Canning Vale, Western Australia, or any other suitable alloy. Alternatively, the substrate 50 can be a monolithic ceramic such as aluminum oxide or silicon carbide (SiC), and ceramic reinforced ceramic matrix composite such as SiC—SiC. In ceramic substrate applications, the substrate 50 may be a bond coat 60 as described below. The circumferential portion 40 around the recessed features, e.g., divots, may be composed of different materials. Each material may contribute different desirable properties such as structural strength and oxidation resistance. One example is a PWA1386 (available from Sulzer Metco (US) Inc. of Westbury, N.Y. as Amdry 365) composition that can form the geometry layer. This can be applied by HVOF (high velocity oxygen fuel spraying) and diffusion heat treatment, for example. It is also contemplated that the surface 52 may be manufactured by additive manufacturing methods such as DLMS (direct laser metal sintering), brazing, or diffusion bonding.

A ceramic topcoat 54 is disposed on the substrate 50. While ceramic topcoat materials have demonstrated high temperature durability in thermal cycle testing, some cracking may occur, especially at corners, e.g., edge interfaces with the substrate 50. In embodiments, a bond coat 60 may be disposed between the topcoat 54 and the substrate 50. The bond coat 60 may be an oxidation resistant alloy referred to generically as MCrAlY.

Figure 4:
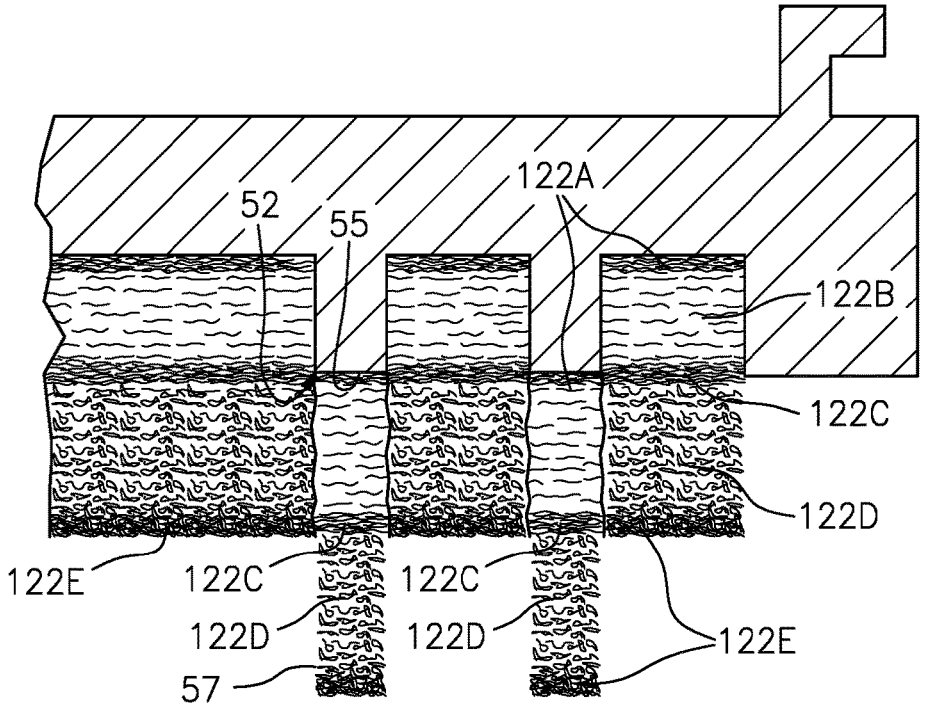
FIG. 4 is the exemplary portion of the turbine article prior to a machining step of the ceramic topcoat.

With reference to FIG. 4, in one embodiment, the topcoat 54 is applied (FIG. 5) to form a multiple of layers 122A-122E that provides a layered structure with differing hardness. The multiple of layers 122A-122E may include a first layer 122A having a first hardness, and a second layer 122B having a second hardness, the first hardness being harder than the second hardness. The areas of greater hardness are of a higher modulus, strength, toughness and higher residual tensile stress than the less dense layers to form toughened layers in specific areas of the topcoat 54. That is, hardness correlates with fracture toughness.

In one example, the ceramic topcoat 54 includes the first layer 122A having a first hardness, the second layer 122B deposited on the first layer 122A. A third layer 122C is deposited on the second layer 122B, the third layer 122C having a hardness about equivalent to the first hardness. In this example, the third layer 122C is at a height in the topcoat 54 to be equivalent with a top surface 55 of the geometric surface 52. The third layer 122C may be of a thickness to be flush or span the top surface 55. A fourth layer 122D is deposited on the third layer, the fourth layer 122D having a hardness about equivalent to the second hardness. Finally, although additional or fewer layers may be provided, a fifth layer 122E is deposited on the fourth layer 122D, the fifth layer 122E having a hardness about equivalent to the first hardness. In one example, the divot depth is about 10-50 mils (thousands of an inch) or 0.381-0.635 mm) such that the first layer 122A thickness spans from 0-15% the divot depth (with 0% being the bottom of the divot) and the third layer 122C thickness spans 90-115% the divot depth. Alternate ranges for the first layer 122A may be 0 to 5, 0-10, 0-20% and the third layer 122C may be for 80-120%, 95-110%.

Figure 5:
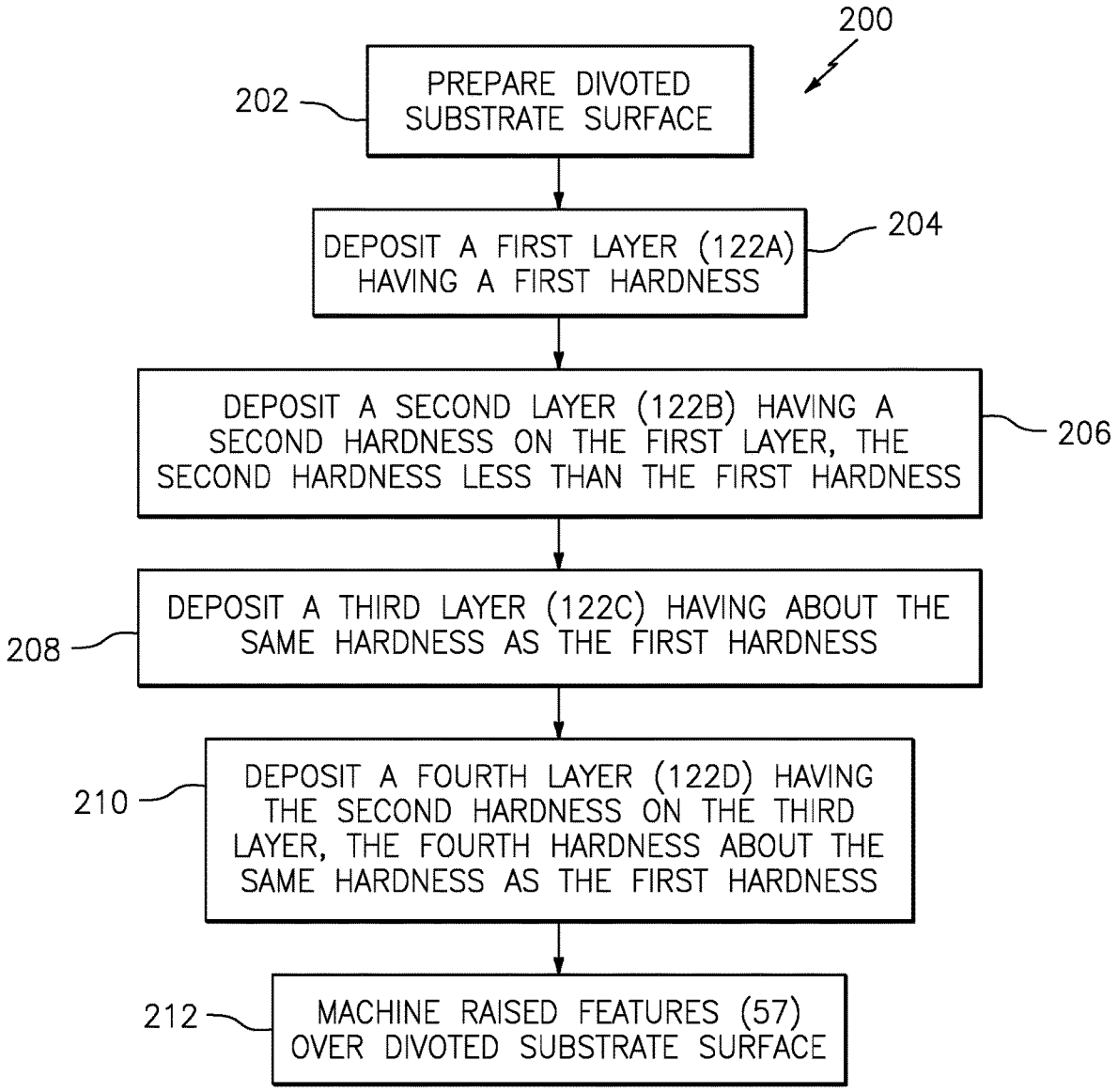
FIG. 5 is a flow chart illustrating a method for manufacture of a portion of the turbine article.

With reference to FIG. 5, a process 200 for manufacturing or repairing a geometrically segmented abradable coating for the component initially includes preparation of the geometrically segmented abradable ceramic (GSAC) surface 52 (202). Preparation may include bond coat 60 application and formation of the divoted surface into the bond coat or application of the bond coat after formation of the divoted surface. The bond coat 60 may be supplied as MCrAlY in powder form. The powder may be deposited by any of a number of processes, however one that produces a dense (e.g. less than 5% porosity), low oxide (e.g., less than 2% oxide) coating is suitable, for example. It is also contemplated that cathodic-arc or cat-arc can also be used, e.g., using an MCrAlY ingot can produce lower oxide and better oxidation resistance. A process that operates with particle velocity greater than 1000 ft/s (304.8 m/s) is suitable, such as in high velocity plasma spray, high velocity oxygen fuel, high velocity air fuel, cold spray and warm spray processes, for example. The thickness of the bond coat 60 may be from 3 to thicker than the divot depth, e.g., 3 to 12 mils.

Preparation may also include that the bond coat 60 and substrate 52 are diffusion heat treated to further improve bonding and oxidation resistance. For example, Amdry 386 powder, available from Sulzer Metco (all Sulzer Metco products described herein are available from Sulzer Metco (US) Inc. of Westbury, N.Y.), is deposited by high velocity oxygen fuel (HVOF) spraying and is then diffusion heat treated at 1975° F. (1079° C.) for 1 hour, e.g., in a protective atmosphere.

Next, the multiple of layers 122A-122E of the topcoat 54 are deposited (204-210) to provide the layered structure. The process may be continuous with spray parameter changes made during the process. Parameter changes may include torch to part distance, plasma power level, gas flow rates, etc. The multiple of layers 122A-122E may be deposited by molten spray particles onto a heated underlying layer. The higher hardness layers may be deposited onto an underlying layer that is hotter than that for the softer layers and similarly with higher level of spray particle or droplet superheat relative to the droplets that create the softer layers. The topcoat 54 can be applied with a near line of sight coating process during which the layers 122 are deposited on the high and low coplanar surfaces that are generally perpendicular to the spray stream.

In a suitable setup for deposition of the multiple of layers 122A-122E, a plurality of bond coated substrates are loaded into a hollow cylindrical fixture such that the bond coated surfaces face the inner diameter of the cylindrical fixture. An auxiliary heat source, such as gas burners, is positioned around the fixture and a system for monitoring and controlling the part temperature is employed. This may include a thermocouple and temperature controller for regulating gas flow to the gas burners. A plasma spray torch is positioned in the interior of the cylindrical fixture for depositing the layers. In another exemplary setup, the articles are insulated and the plasma torch provides the heat. Variable air blower pressure may be employed to limit and control part temperature in this configuration.

The article can be preheated to the desired process temperature and then each of the multiple of layers 122A-122E are deposited. Each coating layer may be deposited with a different preheat temperature. After a preheat time of approximately 10 minutes such that the articles are at the temperature set point, which is in one example, would be 500-1200 F for the harder layers and ambient to 800 F for the softer layers. Air plasma spraying can be used while the part is held at the elevated temperature. As an example, a Sulzer Metco 9 MB torch is operated at 60 kilowatts with 100 scfh (standard cubic feet per hour) (2.83 standard cubic meters per hour) of nitrogen and 25 scfh (0.708 standard cubic meters per hour) of hydrogen gas flow. A suitable powder is a yttria partially stabilized zirconia (yttria partially stabilized zirconia herein refers to a composition of about 12 weight percent or less yttria stabilized zirconia). A composition of between about 6 weight percent and about 20 weight percent yttria stabilized zirconia may be used. In certain applications, a suitable range between about 7 weight percent and about 12 weight percent yttria stabilized zirconia may be chosen based on material strength. Other zirconia-based compositions can be used, such as ceria stabilized zirconia, gadolinia stabilized zirconia, magnesia stabilized zirconia, calcia stabilized zirconia, and mixtures thereof may be substituted for the yttria stabilized zirconia. An example of a suitable powder is Sulzer Metco 204B NS of $ZrO_2$ $8Y_2O_3$ composition. This can be fed through a #2 powder port at 20 g/minute with 12 scfh (0.340 cubic meters per hour) of nitrogen carrier gas. In one example, the articles are arranged on a 30 inch (76.2 cm) diameter fixture which is rotated at 10 rpm. The torch can be traversed back and forth in front of the articles at a 2.75 inch (6.99 cm) stand-off distance and 3 inches (7.62 cm) per minute traverse speed.

Generally, the layers 122A, 122C, and 122E are deposited to provide a toughened layer of the first hardness and the layers 122B, 122D are deposited to provide the second hardness which is less hard than the layers 122A, 122C, and 122E. That is, the layers 122A, 122C, and 122E are toughened layers while the layers 122B and 122D are softer more porous and thus abradable and more thermally resistive layers therebetween. Although the actual values are material dependent, should the more porous softer, abradeable layers (e.g., the layers 122B and 122D) be set to have a hardness of 1, then the layers (layers 122A, 122C, and 122E) can be at least 20% harder. More specifically, a max range of 122-180%, a preferred range of 125-150% with a target of 130% may be utilized. The hardness may be correlated to toughness and the limits may be set in accords to Vickers Hardness with 300 gram load (HV300), again, as ratios.

The layers 122A, 122C, and 122E can include a material with at least one of yttrium stabilized zirconium and gadolinia zirconate. The layers 122A, 122C, and 122E may be composed of 7-8 wt. % yttria stabilized zirconia or other oxide ceramic materials, as these materials have high toughness and suitable thermal stability. Alternatively, the layers 122A, 122C, and 122E may include 7YSZ at 15% porosity, deposited with poly-methyl-methacrylate fugitive particles.

For example, the coating surface underlying each of the layers 122A, 122C, and 122E in the multiple of layers 122A-122E may be heated to 800-1600 degrees F. (1472-2912 degrees C.) during coating application to provide the increased hardness. The spray process also heats the spray particles above their melting point and establishes a super heat condition. That is, the particular layer, when formed from fine, hot, thermal barrier coating particles, exhibits strong inter-particle bonding to form the toughened, harder ceramic layer, e.g., layers 122A, 122C, and 122E. The impinging droplets and part surface are at higher temperatures than in conventional processes such that the incoming droplets become splats which have a greater degree of attachment to the underlying material to increase bonding compared to the splats of layers 122B and 122D. The increased bonding between splats increases internal stresses, so the thickness of layers 122A, 122C and 122E is limited and the spray parameters and temperatures are transitioned to those for the layers 122B and 122D.

In contrast, the coating surface of the underlying layer for the layers 122B and 122D in the multiple of layers 122A-

122E may be heated to ambient temperature −800 degrees F. (68-1472 degrees C.) to provide the relatively less dense layers 122B and 122D. The layers 122B and 122D may be thicker than the layers 122A, 122C, and 122E because the layers 122B and 122D are sprayed at a lower temperature which reduces internal stresses.

The layers 122A, 122C, and 122E may be, for example, 0.5 to 7.5 mils thick, with a specific example being 4 mils thick. Layers 122A, 122C may be in the highest stress locations of the ceramic coating. This delays initiation and slows the propagation of cracks that may otherwise cause delamination. The erosion and spallation resistance imparted by the layers 122A, 122C, and 122E provide stable protection to the bond coat 60 and the substrate 50. In blade outer air seal applications, the erosion and spallation resistance facilitates maintenance of a stable tip clearance during service and reduced degradation of thrust specific fuel consumption over the lifetime of the engine. In thermal barrier applications, the hard and dense top layer 122E protects the articles from exposure to erosive conditions and CMAS infiltration while the layers 122A and 122C reduce spallation. The hard layers 122A, 122C are more dense and resistant to CMAS infiltration than the layers 122B and 122D.

The layers 122B, 122D, are also applied using air plasma spraying to provide the second hardness. This may begin while the articles are still at elevated temperature following application of the underlying layers 122A, 122C, or may be conducted as a separate spray event after the articles have cooled. The powder may be the same as that used for the layers 122A, 122C, and 122E, or may be switched to one of different particle morphology or composition. The relatively harder layers 122A, 122C can be 7YSZ while the abradable or insulating layers are GSZ. The YSZ (7YSZ) provides higher hardness and toughness due to their properties, not spray parameters and interparticle bonding.

In embodiments, parameters may be gradually adjusted while the first 5 mils (1.27×10−4 meters) of each layer 122B, 122C, 122D and 122E are 40 Wt % gadolinia stabilized zirconia powder may be used at a rate of 40 g/minute and injected into the plasma stream with a carrier gas flow rate of 11 scfh (0.311 cubic meters per hour). For example, the layers can be graded one to the next. Torch stand-off distance may alternatively or additionally increased to 5 inches (12.7 cm) and traverse rate to 20 inches (50.8 cm) per minute. Fixture speed may alternatively or additionally be increased to 100 rpm. Coating application is continued until the final desired coating thickness is reached. In this example, each layers 122B, 122D may be about 80% of 25 mils which may includes 5 mils of graded transition much as described above. While an example composition is described, any other suitable composition can be used, for example, the composition can be 8 Wt % yttria stabilized zirconia blended with approximately 6 Wt % of methylmethacrylate particles (SM2602 from Sulzer Metco). The layers 122A, 122C, and 122E can be as thin as about 0.5 mils. In certain embodiments, the coating surface may be ground smooth to remove the raised material 57 over the substrate features (FIG. 4) such that a −10-50 mils thickness remains over the raised substrate features 57.

Once the multiple of layers 122A-122E are deposited, the topmost layer and the material that pile up over the over the raised substrate features 57 are machined (212) (e.g., ground) to provide a final top surface that may be either the relatively hard layer or the relatively soft layers. In this example, the fifth layer 122E is essentially removed. Alternatively, the fifth layer 122E may be a about 5-20 mils thick prior to being machined (FIG. 4), then about 3-10 mils thick after being machined (FIG. 3) to remove the material that pile up over the over the raised substrate features 57. In an embodiment, the topcoat 54 is machined (212) to remove the raised material 57 over the substrate features (FIG. 4). By providing the outermost layer to be a layer that is more dense, the outmost layer is less porous to reduce the potential for melted sand that is generally a mixture of calcium oxide, magnesium oxide, aluminum oxide, and silicon oxide (commonly referred to as CMAS) infiltration and will have reduced sintering shrinkage in service because the porosity is lower. Less sintering shrinkage in service facilitates a reduction in final stress at a location where spallation tends to occur.

The layer is applied to the GSAC structure in relation to the divot structure to provide improved spallation resistance. The coordination of the layer thicknesses in coordination with divot depth and ceramic topcoat thickness can place denser/tougher layers at the bottom of divots and top surface. The toughened mid-height layer that places the layer flush with the metallic substrate. The layers increase spallation resistance. The toughened mid-height layer flush with the metallic substrate specifically interacts with the GSAC substrate structure to minimize heretofore identified cracking locations.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

Although particular step sequences are shown, described, and claimed, it should be understood that steps may be performed in any order, separated or combined unless otherwise indicated and will still benefit from the present disclosure.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be understood that within the scope of the appended claims, the disclosure may be practiced other than as specifically described. For at least that reason, the appended claims should be studied to determine true scope and content.

What is claimed:

1. A turbine article comprising:

a substrate with a geometric surface having a multiple of raised substrate features and a multiple of divots forming coplanar surfaces; and a ceramic topcoat disposed over the geometric surface, the ceramic topcoat comprising a first layer having a first hardness, a second layer on the first layer, the second layer having a second hardness, the first hardness different than the second hardness, a third layer on the second layer, the third layer having a hardness about equivalent to the first hardness, wherein the third layer is flush with a top surface of the geometric surface, the top surface of the multiple of raised substrate features and the bottom of each of the multiple of divots forming coplanar surfaces that are generally perpendicular to a spray stream for depositing the geometrically segmented abradable coating.

2. The turbine article as recited in claim 1, wherein the first layer is located within a bottom of each of the multiple of divots and on a raised area surrounding each divot.

3. The turbine article as recited in claim 1, further comprising a fourth layer on the third layer, the fourth layer having a hardness about equivalent to the second hardness.

4. The turbine article as recited in claim 3, further comprising a fifth layer on the fourth layer, the fifth layer having a hardness about equivalent to the first hardness.

5. The turbine article as recited in claim 4, wherein the coating is machined to remove the portion of the fourth and fifth layers that are raised above the fourth and fifth layers located in the divot locations to produce a machined surface.

6. The turbine article as recited in claim 5, wherein the fifth layer is about 5-20 mils thick prior to being machined.

7. The turbine article as recited in claim 5, wherein the fifth layer is about 3-10 mils thick after being machined.

8. The turbine article as recited in claim 1, wherein the first layer is 1-3 mils thick and the second layer is 6-50 mils thick.

9. The turbine article as recited in claim 1, wherein a divot depth of each of the multiple of divots of the geometric surface is 10-50 mils, the first layer thickness spans from 0-15% of the divot depth (with 0% being the bottom of the divot) and the third layer thickness spans 90-115% the divot depth.

10. The turbine article as recited in claim 1, wherein each of the multiple of divots of the geometric surface comprises a substantially uniform divot depth extending into the substrate and a divot width, wherein the ratio of the divot width to the divot depth is 1 to 10, with the divot depth being at least 0.01 inches (0.254 millimeters).

11. The turbine article as recited in claim 1, wherein the substrate comprises a bond coat.

12. The turbine article as recited in claim 1, wherein the substrate is at least one of metallic, monolithic ceramic, metal matrix composite and a ceramic matrix composite.

13. The turbine article as recited in claim 1, wherein the article is a blade outer air seal.

* * * * *